United States Patent [19]

Yen et al.

[11] 4,043,884

[45] Aug. 23, 1977

[54] ELECTROLYTIC HYDROGENATION OF LEACHED OIL SHALE COMPONENTS

[75] Inventors: Teh Fu Yen, Altadena; Chaur-Shyong Wen, Los Angeles, both of Calif.

[73] Assignee: University of Southern California, Los Angeles, Calif.

[21] Appl. No.: 716,858

[22] Filed: Aug. 23, 1976

[51] Int. Cl.[2] ..... C25B 3/00

[52] U.S. Cl. ..... 204/131; 204/130

[58] Field of Search ..... 75/1 R, 2; 204/130–131, 136, 73 R

[56] References Cited

U.S. PATENT DOCUMENTS 3,915,819 10/1975 Bell et al. ..... 204/136

*Primary Examiner*—R. L. Andrews

*Attorney, Agent, or Firm*—Nilsson, Robbins, Dalgarn & Berliner

[57] ABSTRACT

The kerogen components of shale oil are upgraded by reductive electrolysis.

5 Claims, No Drawings

ELECTROLYTIC HYDROGENATION OF LEACHED OIL SHALE COMPONENTS

FIELD OF THE INVENTION

The invention relates to the hydrogenation upgrading of shale oil components.

BACKGROUND AND SUMMARY OF THE INVENTION

Oil shale is a natural sedimentary rock containing an abundance of residual organic material which, when processed, can be made into oil and fuel products. Typically, oil shale, such as exemplified by the Green River formation in Wyoming, Colorado and Utah, has about 15–20% organic material embedded in an inorganic mineral matrix. The organic portion is composed generally of a soluble bitumen fraction an insoluble fraction in which kerogen constitutes the bulk of the insoluble organic material. The bitumen fraction is readily solubilized by organic solvents and can be removed for refinement by physical means. Th keorgen portion is characterized by its insolubility in organic solvents and is therefore more difficult to remove. In Green River oil shale, kerogen makes up about 75% of the organic components and in most all oil shale is the major organic component.

The inorganic mineral matrix in which the desired organics are trapped is composed primarily of carbonate materials such as dolomite and calcite, quartz and silicate minerals such as analcite or other zeolites. Several approaches have been used with oil shale for separating the organics from the mineral matrix. The usual process comprises crushing the matrix rock and subjecting the crushed matrix to heat in a retort to distill off the kerogen. Other processes involve erosion of the inorganics, for example, by acid leaching, to keep the organics intact. The kerogen component contains considerable quantities of nitrogen-, sulphur and oxygen-compounds, which contribute in large part to the high decomposition temperature for the kerogen and which produce significant pollutants during the usual retorting process. Attempts have been made to hydrogenate the kerogen fraction to remove these undesirable components and to upgrade the shale oil to more conventional petroleum characteristics. Since chemical reducing agents do not greatly affect the kerogen, extremely strong reducing conditions have been applied. Chemical reduction of kerogen has required high pressures and high temperatures (e.g., 4200 psig and 355° C). Such drastic conditions increase the possibility for molecular rearrangements, limiting the desirability of this technique. The hydrogenation of solid fossil fuels such as coal, was accomplished by electrochemical means by Sternberg et al. in 1966. See in this regard, H. W. Sternberg et al., "Electrochemical Reduction in Ethylenediamine", Coal Science (R. F. Gould, Ed.) ACS Pub., Washington, D.C. 1966, Chapter 33. In that process, hydrogenation was conducted in ethylenediamine in the presence of lithium chloride under mild conditions (30° C and 1 atmosphere) with an addition of 33 hydrogens per 100 carbon atoms and a decrease in sulfur content. The presence of large amounts of carbonates and silicates and general matrix configuraion of oil shale discourages application of such a reduction process to oil shale.

The present invention provides a means for recovering economic values of oil shale by electrolytic hydrogenation by first leaching the carbonate matrix from the shale and subjecting the resultant residue to reductive electrolysis. Leaching out the carbonate components develops the porosity and permeability of the residue, increasing the extent of its internal surface and providing an interconnected pore structure which aids in releasing the bridge portions of the kerogen (i.e., amides, cycloalkadines, esters, and heterocyclic compounds). The released bridge components of kerogen serve as proton-donors for further electrolytic refining. The reduced residue can be separated from the electrolyzed slurry, for example, by centrifugation, to yield an upgraded product. Electrolysis is preferably conducted at a current density above about 50 amperes per square meter of anode surface (50 A/m$^2$)for a period of at least an hour, or for several days, if necessary, at low current density. A current density of up to 300 A/m$^2$ can be used.

DETAILED DESCRIPTION

The following description will relate, for exemplification, to processing in an industrial plant environment. However, it is to be understood that reductive electrolysis as described herein is also applicable directly to the shale formation in situ provided that the oil shale is pre-leached. In this regard, reference can be made to proposed methods of bioleaching of oil shale in situ. See, for example, "Effects of Bioleaching on Oil Shale", A.C.S. Div. of Fuel Chem. Preprint 19, 94, 99 (1974) by W. C. Meyer and T. F. Yen. In such case, an electrolytic cell can be defined by the appropriate placement of anodes and cathodes in the leached deposits. Accordingly, the process as defined herein is meant to include such broader considerations.

Initially, the oil shale is ground to pass at least a 60 mesh screen, U.S. Standard and an organic solvent such as benzene or the like is added to solubilize the bitumen in the shale. The solubilized bitumen is extracted and the residue is leached by adding a mineral acid, such as hydrochloric acid, to the extracted shale. Residual acid and reaction products of leaching are remove by washing, yielding a kerogen concentrate. The kerogen concentrate is then slurried with a reductive electrolytically active solution and the slurry is subjected to reductive electrolysis. The electrolysis is conducted for at least one hour at a current density of at least 50 A/m$^2$. Generally, the electrolysis can be conducted at room temperature or lower, e.g. by using an ice bath, and atmospheric pressure is satisfactory. The reduced residue is separated from the electrolyzed slurried to provide an upgraded product.

As a reductive, electrolytically active solution, one can utilize a combination of ethylene diamine and lithium chloride and reference in this regard can be made to the aforementioned application by Sternberg et al. Other electrolytically reductive solutions and combinations can be utilized.

Isolation of the product can be accomplished by placing the reduced mixture into an aqueous solution, such as ice water, to congeal the kerogen components and the kerogen can be separated by centrifugation or other separation procedure.

The following example will illustrate application of the process.

Oil shale such as obtained from the Green River formation, can be ground to pass a 100 to 150 mesh screen, U.S. Standard. For example, 10 grams of such a shale can be extracted with 100 milliliters of benzene to remove soluble organic material (bitumen). The extracted shale can be treated with 7.4% hydrochloric acid for 24 hours and the leached material Soxhlet extracted with a mixture of benzene:methanol (4:1) for 48 hours to remove the soluble bitumen. The resultant residue can then be treated with a 1:1 by volume mixture of concentrated hydrofluoric acid (48%) and hydrochloric acid (37%), followed by filtration and washing of the residue repeatedly with boiling water until the filtrate is neutral. The residue can then be dried, e.g. at 75° C in an oven for several hours, to obtain a kerogen concentrate.

Electrolytic hydrogenation of kerogen concentrate obtained as above was carried out in a 250 milliliter flask with three necks which were fitted with reducing tube adaptors. The center adaptor was fitted with a thermometer which could be immersed in the solution. An aluminum sheet was sealed through one end adaptor neck, into the flask, and had a surface of 12 centimeters square immersed in the electrolyte, serving as the cathode. A carbon rod, 3.5 centimeters long and 0.5 centimeters in diameter, was used as the anode, passing by a lead through the other end neck.

A sample of 1 gram of the foregoing kerogen concentrate in 100 milliliters of ethylene diamine containing 1.4 grams of lithium chloride was placed in the flask. A current was applied and kept constant at 50 milliamp/cm$^2$ by adjustment of the potential, which was in the range of 70 to 80 volts. During electrolysis, the flask was kept at a constant temperature of about 35° C by application in an ice bath. Electrolysis was conducted for 30 hours.

To isolate the products, the reduced mixture was poured into 100 milliliters of ice water and the reduced kerogen was separated from the mixture by centrifugation. Washing and centrifugation were repeated until the washings had a pH of 8, as shown by test paper. The residue was then transferred to a round flask, dried by a stream of nitrogen and placed in an oven at 75° C.

A portion of the solid residue was analyzed by infrared spectroscopy and an elemental analysis was obtained. The remaining portion of the solid residue was Soxhlet extracted with heptane for 10 hours and then dried and extracted again with a mixture of benzene:methanol (volume 4:1) for 48 hours. The heptane and benzene:methanol extracts were analyzed by gas chromatography using a 10 feet $\times \frac{1}{8}$ inch glass column packed with 5% Carbowax 20M on Chromosorb W. The centrifuged liquid layer from the electrolyzed mixture was evaporated to 50 milliliters and neutralized with carbon dioxide gas to a pH of 8, then extracted with heptane and chloroform. The extracts were analyzed with gas chromatography and infrared spectroscopy.

The gas chromatogram of the heptane soluble extract from the reduced kerogen showed the extract to be composed of predominantly normal alkanes having from 22 to 28 carbon atoms. Identification of peaks was accomplished by co-injection of known standards and by comparison of the chromatographic retention times of each compound with those of standard kits. The distribution of the normal alkanes is presented in Table 1 below.

TABLE 1

| n-Alkane | Relative Quantity |
|---|---|
| $C_{19}$ | 0.01 |
| $C_{20}$ | 0.03 |
| $C_{21}$ | 0.15 |
| $C_{22}$ | 0.39 |
| $C_{23}$ | 0.72 |

TABLE 1-continued

| n-Alkane | Relative Quantity |
|---|---|
| $C_{24}$ | 1.00 |
| $C_{25}$ | 0.90 |
| $C_{26}$ | 0.70 |
| $C_{27}$ | 0.60 |
| $C_{28}$ | 0.38 |
| $C_{29}$ | 0.23 |
| $C_{30}$ | 0.18 |
| $C_{31}$ | 0.15 |
| $C_{32}$ | 0.08 |

The total yield of the heptane-soluble product was about 3.7% of the original kerogen concentrate. The extract of the benzene:methanol-soluble fraction of reduced kerogen consisted of an orange-brown, semi-solid material which was about 6.4 weight percent of the original kerogen concentrate. The following Table 2 compares elemental components of the original kerogen concentrate to that of reduced samples.

TABLE 2

| | Original Kerogen Concentrate | Reduction[a] Sample 1 | Reduction[b] Sample 2 |
|---|---|---|---|
| Carbon, %w | 68.60 | 40.71 | 40.55 |
| Hydrogen, %w | 8.42 | 6.41 | 6.47 |
| Nitrogen, %w | 3.48 | 3.25 | 3.34 |
| Sulfur, %w | 2.41 | 0.14 | 0.22 |
| H/C atomic ratio | 1.47 | 1.82 | 1.84 |

[a]Reduced sample obtained from washings and centrifugations.
[b]Reduced sample obtained after heptane and benzene:methanol extraction.

The calculation of the atomic ratio of hydrogen to carbon is on an ash-free basis. Some of the loss of sulfur is likely caused by elimination of sulfur from heterocyclic organic structures.

The heptane and chloroform extracts from the liquid layer were analyzed by gas chromatography which showed the presence of normal $C_{20}$, $C_{21}$ and $C_{22}$ alkanes present among a group of peaks.

It will be seen that electrolytic reduction of kerogen concentrate is a powerful technique to break down the cross-link matrix of kerogen. The decrease of sulfur content is an important advantage and normal alkane extracts from reduced kerogen offers a feasible large-scale electrolytic solvent refining process. Various modifications, changes and alterations can be made in the present process and its steps and parameters. All such modifications, changes and alterations as are within the scope of the appended claims form part of the present invention.

We claim:

1. A process for upgrading the kerogen components of oil shale, comprising:

leaching carbonate minerals from said oil shale to form a porous residue;

forming a slurry of said residue with a reductive electrolytically active solution;

subjecting said slurry to reductive electrolysis; and separating the reduced residue from the electrolyzed slurry.

2. The process of claim 1 including the step prior to forming said slurry, of solvent-extracting bitumen from said residue.

3. The process of claim 1 in which said reduced residue is separated by centrifuging said electrolyzed slurry.

4. The process of claim 1 in which said electrolysis is conducted for at least 1 hour at a current density of at least 50 A/m$^2$.

5. A process for treating raw oil shale for upgrading of shale oil therefrom, comprising:

grinding said oil shale to pass at least a 60 mesh screen, U.S. Standard;

adding an organic solvent for bitumen to said ground shale to solubilize bitumen in said shale, and extracting said solubilized bitumen;

adding a mineral acid to said extracted shale for leaching carbonate minerals;

washing to remove residual acid and reaction products of said leaching to obtain a kerogen concentrate;

slurrying said kerogen concentrate with a reductive, electrolytically active solution;

subjecting said slurry to reductive electrolysis for at least 1 hour at a current density of at least 50 $A/m^2$; and separating the reduced residue from the electrolyzed slurry.

* * * * *